United States Patent [19]

Jacobsen et al.

[11] 4,393,925

[45] Jul. 19, 1983

[54] STOVE PIPE HEAT EXTRACTOR

[76] Inventors: Kenneth J. Jacobsen, 14005 SW. Bonnie Brae Ct., Beaverton, Oreg. 97005; Jerome F. Moshofsky, 9019 SW. 15th St., Portland, Oreg. 97219

[21] Appl. No.: 847,798

[22] Filed: Nov. 2, 1977

[51] Int. Cl.[3] ..... F24F 3/02

[52] U.S. Cl. ..... 165/122; 165/155; 165/DIG. 2; 432/223

[58] Field of Search ..... 165/81–83, 165/155, 156, 160, DIG. 2, 122; 237/53; 126/110 R; 432/223

[56] References Cited

U.S. PATENT DOCUMENTS

| | | | |
|---|---|---|---|
| 2,122,228 | 6/1938 | Goehler | 165/155 |
| 2,806,677 | 9/1957 | Jacobs | 165/156 |
| 2,967,047 | 1/1961 | Schluderberg | 165/81 |
| 2,991,981 | 7/1981 | Andersen | 165/155 |
| 3,183,960 | 5/1965 | Prat | 165/122 X |
| 3,446,279 | 5/1969 | White et al. | 165/155 |

FOREIGN PATENT DOCUMENTS

| | | | |
|---|---|---|---|
| 1069321 | 11/1959 | Fed. Rep. of Germany | 165/155 |
| 91787 | 3/1938 | Sweden | 165/155 |

*Primary Examiner*—William R. Cline
*Assistant Examiner*—Theophil W. Streule, Jr.
*Attorney, Agent, or Firm*—Klarquist, Sparkman, Campbell, Leigh, Whinston & Dellett

[57] ABSTRACT

A heat extractor for picking up waste heat from flue gases is disclosed. The extractor attaches to the stove pipe of a furnace or stove. Air is introduced into the extractor in a spiral flow pattern which is reversed after the air is heated. Air flows into the room from the extractor in a 360° pattern.

3 Claims, 3 Drawing Figures

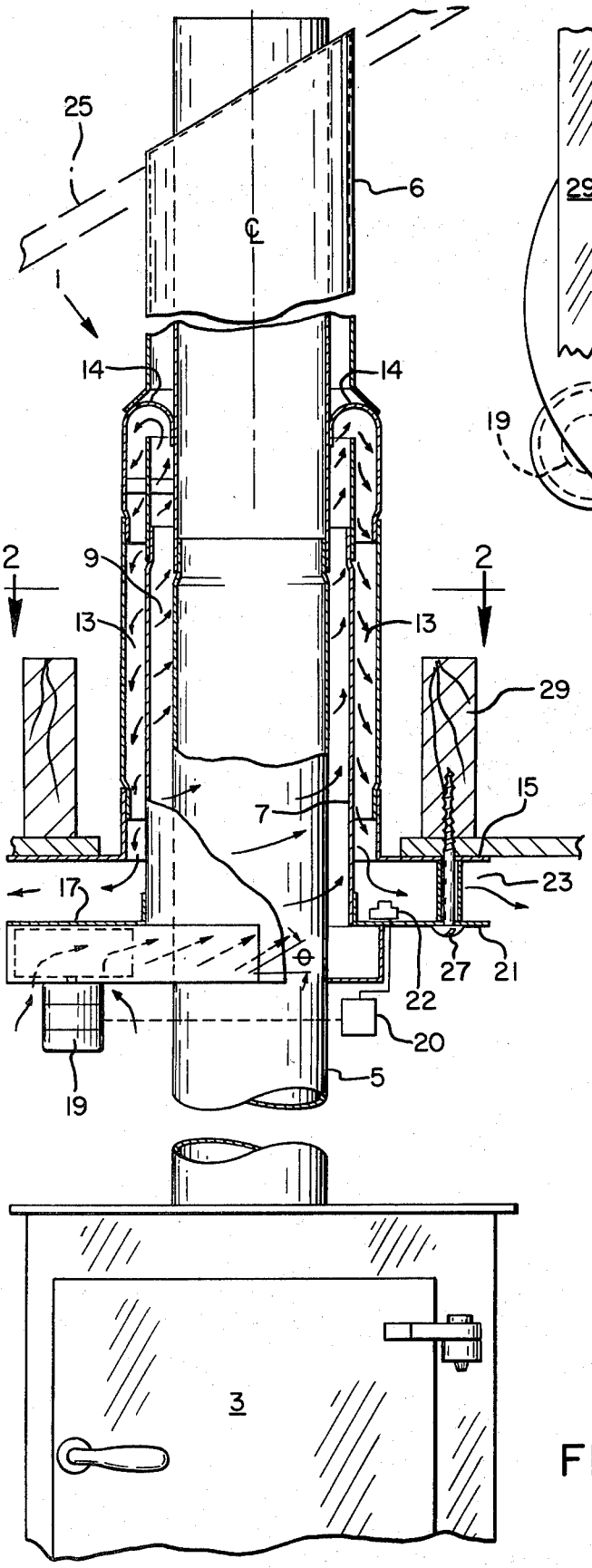
FIG. 1
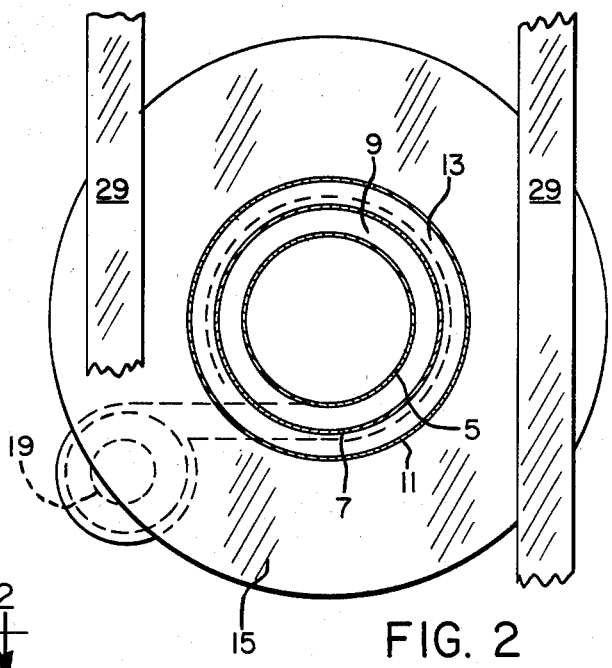
FIG. 2
FIG. 3
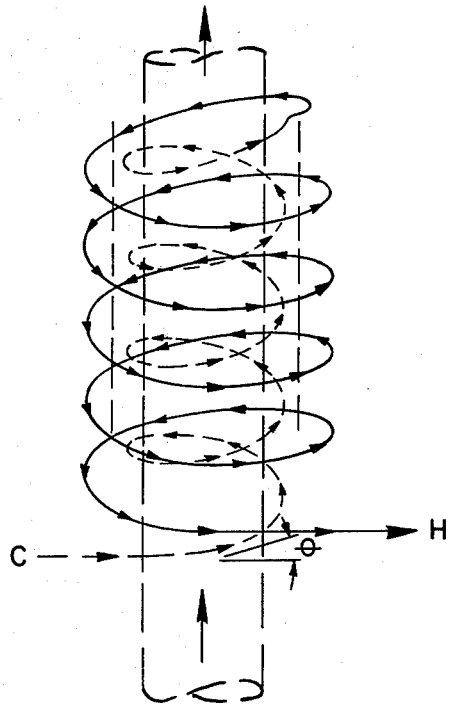

STOVE PIPE HEAT EXTRACTOR

BACKGROUND OF THE INVENTION

1. Field of the Invention

The disclosed invention pertains to heat extractors in general and more particularly to those which comprise a section of stove pipe in a heating system.

2. Description of the Prior Art

Numerous devices exist in the prior art for extracting heat from flue gases. These devices are aimed at recovering heat which would otherwise be lost by passage up the chimney. One such device is shown in U.S. Pat. No. 2,816,714. Another is shown in U.S. Pat. No. 2,902,265. Many heat extractors consist of devices which mount in the firebox of a stove or fireplace and pass air through a closed loop to pick up waste heat as in U.S. Pat. No. 3,866,595. Still others are built after the manner of the circulating fireplace wherein an air path is constructed behind the brick lining of the fireplace and air is circulated therein to pick up waste heat from the warm bricks. A variation of this construction is shown in British Pat. No. 785,699.

SUMMARY OF THE INVENTION

The invention is directed to improvements in recovering otherwise wasted heat from rising flue gases in a stove pipe. A principal object of the invention is to provide a device which replaces a portion of stove or chimney pipe and provides a means of circulating room air along a spiral path to pick up waste heat.

A further object it to provide a device which picks up heat but presents a relatively cool surface to the surrounding wood structure.

A further object of the invention is to provide an extractor having a spiral air flow path combined with a reverse flow air path.

Throughout the following description the further objects and advantages of the invention will become apparent to those skilled in the art.

BRIEF DESCRIPTION OF THE DRAWINGS

FIG. 1 is a sectional view of the device shown in relationship to a stove and mounted in the ceiling of a house.

FIG. 2 is a sectional view taken along line 2—2 of FIG. 1.

FIG. 3 is a schematic presentation showing the long spiral air flow path along the inner pipe with air direction reversal in the outer jacket.

DETAILED DESCRIPTION

Referring now to the drawings, FIG. 1 shows a heat extractor (1) attached to a stove (3). The extractor has an inner pipe (5) through which passes hot flue gases from stove (3). A heat shield (6) surrounds pipe (5) at its upper end where pipe (5) passes through the roof of a building. An inner jacket (7) surrounds pipe (5) in spaced apart relation so as to provide an inner air path (9). An outer jacket (11) surrounds inner jacket (7) so as to define a second, or outer, air path (13). At the upper end of outer jacket (11) and above inner jacket (7), is a toroidal shaped, downwardly curved lip (14) open at the bottom and which serves to reverse air flow moving upward in air path (9). Lip (14) directs the flow downward in a spiral pattern in air path (13). This doubler spiral air flow path is shown schematically in FIG. 3. At the lower end of jacket (11) is a lip (15) which defines the upper surface of a hot air exit vent (23). An air intake manifold (17) having a fan (19) therein is connected to the inner jacket (7). A thermostat (20) is connected to a control (22) for fan (19). Manifold (17) includes a lip (21) which defines the lower surface of the hot air exit vent (23). Lips (15) and (21) are concentric to pipe (5). Vent (23) which is formed out of lips (15) and (21) is thus able to blow warm air into a room in any direction, substantially normal to the longitudinal central axis (Lc) of extractor (1). As shown in FIG. 1 the extractor is mounted in a ceiling (25) by bolts (27) which attach to ceiling joists (29).

OPERATION

Hot gases from stove (3) rise in pipe (5) heating the pipe surface. Air is drawn in through manifold (17) by fan (19) and blown into air path (9) as defined by inner jacket (7) and pipe (5). From FIGS. 1 and 3 it is seen that air is blown in at an angle $\theta$ relative to the longitudinal central axis (Lc) of extractor (1). The angle $\theta$ may range from 45° to 89°. This can be achieved in a variety of ways such as mounting fan (19) angularly or constructing manifold (17) to direct the air angularly into path (9). This creates a spiral flow pattern as the air moves upward in jacket (7) along air path (9). The result is a very long air travel path as shown in FIG. 3. The flowing air picks up heat from the surface pipe (5) as it moves spirally upward. The flowing air then contacts curved lip (14) and spills over into air path (13), defined by outer jacket (11) and inner jacket (7). Flow direction is reversed and air flows downward along air path (13) and out through vent (23) into the room in a 360° directional pattern. The spiral path greatly facilitates even distribution of warmed air. The combination of reverse flow direction and spiral air path provides a means for raising air temperature appreciably in a very compact space. At the same time outer jacket (11) is much cooler than pipe (5). Thus the relatively cool jacket (11) contacts the building and its wood framework to minimize or eliminate fire hazard.

Having disclosed the preferred embodiment of my invention and described it in detail, it will be apparent to those skilled in the art that many modifications and changes could be made without departing from the true spirit and scope of the invention. I claim as my invention all such modifications and changes as fall within the scope of the appended claims.

We claim:

1. A stove pipe heat extractor comprising:

a hot gas conducting inner pipe having a longitudinal central axis;

an inner jacket surrounding the inner pipe, the pipe and inner jacket defining a first air path;

an outer jacket surrounding the pipe and inner jacket, the inner and outer jackets defining a second air path;

means for introducing air into the first air path in a spiral upward air flow pattern;

means for reversing air flow from the first air path and directing the flow downward in a spiral flow pattern into the second air path;

and an air exit vent operatively connected to the second air path.

2. Apparatus according to claim 1 wherein the air vent defines means for directing warm air into a room in a 360° pattern from the longitudinal central axis of the inner pipe.

3. A stove pipe heat extractor comprising:

a hot gas conducting inner pipe having a longitudinal central axis;

an inner jacket surrounding the pipe;

an outer jacket surrounding the inner jacket and pipe, the inner jacket and pipe defining a first air path and the inner jacket and outer jacket defining a second air path;

an air intake manifold having a fan therein mounted angular to the longitudinal central axis of the inner pipe and operatively connected to the first air path so that by direction of air from the fan tangential to the wall of the inner pipe at an angle to the central axis of the pipe a spiral air flow pattern is created in the first air path by air introduced therein from the manifold;

a toroidal shaped lip operatively connected to the pipe and to the outer jacket above the inner jacket, the lip operative to direct air flowing from the first path into the second path in a direction opposite that of flow in the first path;

and a 360° air exit duct operatively connected to the second air path.

* * * * *